US007584949B2

(12) United States Patent
Kaneko et al.

(10) Patent No.: US 7,584,949 B2
(45) Date of Patent: Sep. 8, 2009

(54) BOOKBINDING SYSTEM, IMAGE FORMING APPARATUS, AND BOOKBINDING APPARATUS

(75) Inventors: Masahiro Kaneko, Hino (JP); Saburo Shimizu, Hachioji (JP); Kohji Yoshie, Sagamihara (JP); Riichi Hama, Hachioji (JP); Kiyoshi Hata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 174 days.

(21) Appl. No.: 11/440,002

(22) Filed: May 25, 2006

(65) Prior Publication Data

US 2007/0035081 A1 Feb. 15, 2007

(30) Foreign Application Priority Data

Aug. 11, 2005 (JP) ..... 2005-232893
Mar. 20, 2006 (JP) ..... 2006-076262

(51) Int. Cl.
*B65H 37/04* (2006.01)

(52) U.S. Cl. ..... 270/58.12; 270/58.05; 270/58.07; 270/58.08

(58) Field of Classification Search ..... 270/58.04, 270/58.05, 58.07, 58.08, 58.12
See application file for complete search history.

(56) References Cited

U.S. PATENT DOCUMENTS

| | | | | |
|---|---|---|---|---|
| 4,395,031 | A * | 7/1983 | Gruber et al. | 270/52.29 |
| 5,735,659 | A * | 4/1998 | Kosasa et al. | 412/9 |
| 5,988,620 | A * | 11/1999 | Graushar | 270/1.02 |
| 6,338,603 | B1 * | 1/2002 | Cerruti | 412/1 |
| 6,685,416 | B2 * | 2/2004 | Itoh et al. | 412/37 |
| 6,705,604 | B2 * | 3/2004 | Lorenzi | 270/32 |
| 2004/0141830 | A1 * | 7/2004 | Yoshie et al. | 412/1 |

* cited by examiner

*Primary Examiner*—Gene Crawford
*Assistant Examiner*—Leslie A Nicholson, III
(74) *Attorney, Agent, or Firm*—Finnegan, Henderson, Farabow, Garrett & Dunner, L.L.P.

(57) ABSTRACT

By controlling the recording position of images on the cover sheet by the image recording section based on the thickness information of the bundle of sheets, image recording at the appropriate position has been made possible irrespective at the amount of trimming of the cover sheet that is trimmed to an appropriate length in accordance with the thickness of the bundle of sheets to be wrapped and bound with the cover sheet.

6 Claims, 15 Drawing Sheets

BOOKBINDING SYSTEM, IMAGE FORMING APPARATUS, AND BOOKBINDING APPARATUS

This application is based on Japanese Patent Application No. 2005-232893 filed on Aug. 11, 2005 and No. 2006-076262 filed on Mar. 20, 2006 in Japanese Patent Office, the entire content of which is hereby incorporated by reference.

BACKGROUND OF THE INVENTION

The present invention relates to bookbinding systems, image forming apparatuses, and bookbinding apparatuses that prepare booklets of bundles of sheets on which image forming has been carried out, wherein the bundles of sheets are covered with cover sheets on which images have been recorded by an image recording device.

In general, a sheet on which an image is recorded by a main body of an image forming apparatus such as a copying machine, a facsimile machine, a printer or a multifunctional machine including functions of the preceding machines is processed in many ways such as, for example, punching holes, stapling, saddle stitching, center folding, attaching a cover, folding, stamping or pasting and bookbinding, as post-processing.

Further, the title of the book or the like is commonly printed on the cover sheet of the bound book in order to clearly indicate the content of the book, and it is widely known to bind the printed cover sheet along with the bundle of sheets by punching holes and passing a spiral ring or the like through the holes, or to bind by stapling with staples, or to bind by applying a paste.

In Patent Document 1, a bookbinding apparatus has been disclosed that is provided with a printing section for printing on the spine portion of cover sheet bonded to the bundle of sheets, and for restricting the character sizes that can be printed according to the thickness of the bundle of sheets.

Further, in Patent Document 2, in an image forming apparatus provided with a bookbinding apparatus, a bookbinding apparatus has been disclosed that is provided with a section for trimming and adjusting the length of the sheets by detecting the sheet size, the sheet thickness and the number of sheets beforehand.

However, in the case of the apparatus described in Patent Document 1, the width of the cover on the spine portion has been determined beforehand. Therefore the apparatus is not one which trims an edge part of the cover sheet in the width direction of the cover sheet on the spine portion according to the thickness of the bundle of sheets and further is not one which properly adjusts the location of printing in the width direction with respect to the cover sheet on the spine portion.

Further, in the bookbinding apparatus of Patent Document 2, although description has been given about the device that cuts to adjust the length of the cover sheet, no description has been given of the device for recording images on the cover sheet.

Patent Document 1: Non-examined Japanese Patent Publication No. Hei 8-85275

Patent Document 2: Non-examined Japanese Patent Publication No. 2004-209869

SUMMARY

The present invention is as follows:

(1) A bookbinding system with the feature that it has an image recording device that records images on a cover sheet, a trimming device that cuts the edge part of said cover sheet that enwraps a bundle of sheets made up of a plurality of sheets based on the thickness information of said bundle of sheets, a binding device that binds said bundle of sheets after wrapping it with said cover sheet, and a control device that controls the recording position of images on said cover sheet recorded by said image recording device based on said thickness information of said bundle of sheets.

(2) An image forming apparatus with the feature that it is an image forming apparatus to which a bookbinding apparatus can be attached, and which includes a cover sheet storage section that can store cover sheets that enwrap bundles of sheets using the bookbinding apparatus, and a control device that controls the recording position of images on said cover sheet based on said thickness information of said bundle of sheets.

(3) A bookbinding apparatus that can be attached to an image forming apparatus, with the feature that said bookbinding apparatus includes a sheet bundle thickness detection device that detects the thickness of the bundle of sheets, a trimming device that cuts the edge part of a cover sheet that enwraps said bundle of sheets based on the result of detection by said sheet bundle thickness detection device, a binding device that binds said bundle of sheets after wrapping it with said cover sheet, and a transmission device that transmits the thickness information of said bundle of sheets based on the result of detection by said sheet bundle thickness detection device to said image forming apparatus.

DETAILED DESCRIPTION OF THE PREFERRED EMBODIMENT

Figure 1:
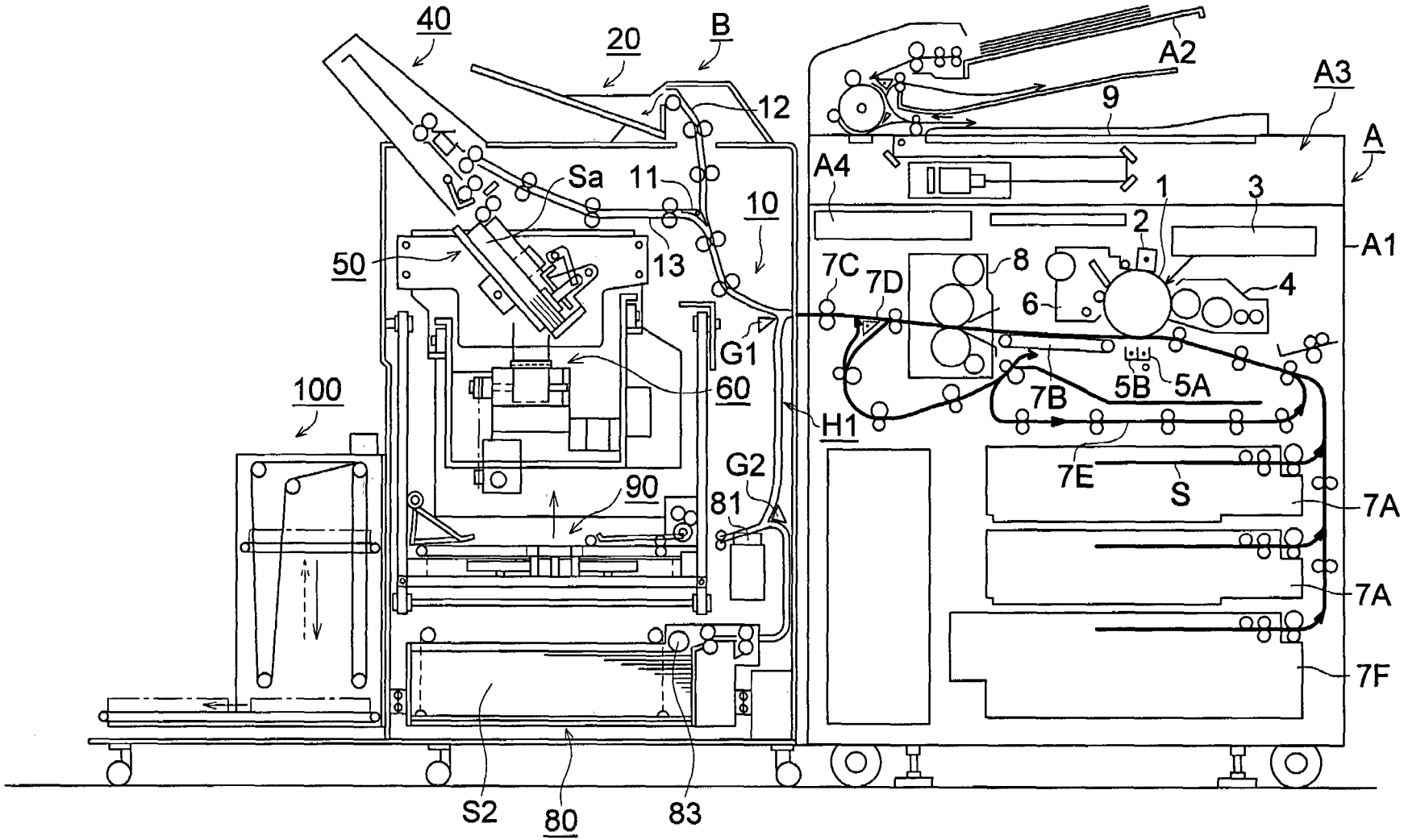
FIG. 1 is an overall configuration diagram of an image forming system provided with an image forming apparatus and a pasting and bookbinding apparatus.

Next, a bookbinding apparatus, an image forming apparatus and a bookbinding system of the invention will be explained as follows, referring to the drawings.

<Image Forming Apparatus A>

FIG. 1 is an entire structure diagram of a bookbinding system equipped with an image forming apparatus A and a bookbinding apparatus B.

Image forming apparatus A has an image recording device in which rotary image carrier 1, charging unit 2, image exposure unit 3, developing unit 4, transfer unit 5A, neutralizing unit 5SB and cleaning unit 6 are arranged around rotary image carrier 1 in an image forming apparatus main body. In the image recording device, exposure scanning based on image data obtained from a document through reading by a laser beam of the image exposure unit 3 is conducted after a surface of the image carrier 1 is charged evenly by the charging unit 2, to form a latent image, and the latent image is developed reversely by the developing unit 4, and a toner image is formed on a surface of the image carrier 1. The image data can be image information made in and received from image data generating device such as a personal computer PC as an exterior apparatus.

Further, in the following descriptions, the constitutive sheets are denoted by S1, the bundle of sheets is denoted by Sa, the sheet for the cover sheet is denoted by S2, and the booklet formed by joining the bundle of sheets and the cover sheet is denoted by S3. In addition, the cover sheet S2 may be indicated as the cover sheet S2A on which images have been printed by the image forming apparatus, while distinguishing it from the cover sheet S2B which is the cover sheet that is stored inside the bookbinding apparatus.

The sheet storing section is provided with sheet storing section 7A storing sheet S1 and cover sheet storing section 7F capable of storing cover sheet S2 and sheet S1 fed from sheet storing section 7A is transported to a transfer position. In the transfer position, the toner image stated above is transferred onto sheet S1 by the transfer unit 5A. After that, charges on the reverse side of the sheet S1 is eliminated by the neutralizing unit 5B and the sheet S1 is separated from the image carrier 1 to be transported by transportation section 7B, and then, is heated and fixed by fixing unit 8 to be ejected from sheet ejection roller 7C.

When forming images on both sides of sheet S1, sheet S1 subjected to heating and fixing by fixing unit 8 is diverted from an ordinary sheet ejection path by transportation path changeover plate 7D, then, is reversed upside down through a movement in a form of a switchback in reversing transportation section 7E, and passes the image forming section again so that an image is formed on the back of sheet S1, and is ejected out of the apparatus from sheet ejection roller 7C through fixing unit 8. Sheet S1 ejected from the sheet ejection roller 7C is fed into bookbinding apparatus B.

In addition, when carrying out image formation on the cover sheet S2 in the image forming apparatus A, the cover sheet S2 that is heat fixed by the fixing section 8 is diverted from the normal sheet discharge path by the transportation path changeover plate 7D, and at the point of time when the trailing edge of the cover sheet S2 has passed over the branching point, the direction of rotation of the respective transporting rollers gripping the cover sheet S2 is changed and the leading and trailing edges are reversed and transported towards the sheet discharge roller 7C, and the cover sheet is discharged to the outside of the equipment by the discharge roller 7C.

The document feeder A2 conveys the document one sheet at a time to the reading position. The image reading section A3 reads out the images in the document that has been transported by the document feeder A2 or in the document placed on the document table 9, and generates image signals. The communication section A4 carries out communication with the network equipment, and generates the image signals as the image information upon receiving the image formation command transmitted from the network.

With respect to the surface of image carrier 1 after image processing, developing agents remaining on the surface are removed by cleaning device 6 so that the image carrier 1 turns out to be ready for the succeeding image forming.

Next, although a bookbinding apparatus according to the present invention is described as a first preferred embodiment based on a pasting and bookbinding apparatus B that uses paste as the bookbinding medium, the present invention shall not be restricted to the preferred embodiments given hereunder.

<Bookbinding Apparatus B>

Figure 2:
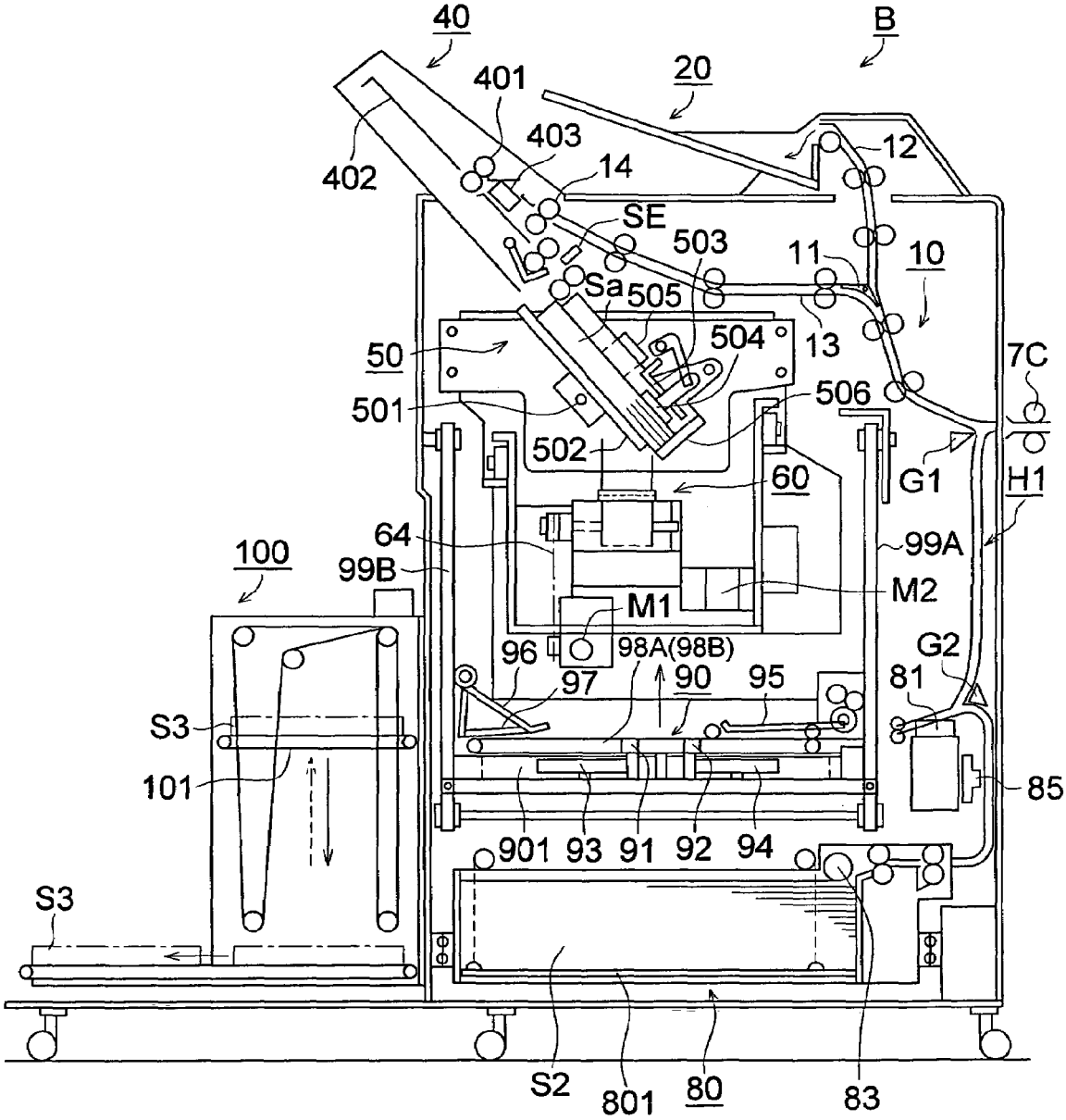
FIG. 2 is a cross-sectional view diagram of a pasting and bookbinding apparatus.

FIG. 2 is an outline front cross-sectional view diagram of the bookbinding apparatus B.

The bookbinding apparatus B has a conveying section 10 that conveys the sheet S1 discharged from the image forming apparatus A to the sheet discharge tray 20 or to the sheet inverting section 40, a collection section 50 that collects the sheets S1 sent one sheet at a time from the sheet inverting section 40, a coating device 60, a cover sheet storage section 80 as a second cover sheet storage section that stores the sheets S2B, sheet feeding rollers 83 that feed the cover sheets S2B, a cutter 81 as a trimming device that trims the cover sheets S2 to a length corresponding to the bundle of sheets S1, a cover sheet supporting section 90 that supports the cover sheets, and a book discharging section 100.

The changeover gate G1 changes the transportation path of the sheet S1 or the cover sheet S2 discharged from the image forming apparatus A.

When the sheet discharged from the image forming apparatus A is a sheet S1, the sheet S1 is sent to the transportation path 10 due to the selection of the changeover gate G1, and is either discharged to the sheet discharge tray 20 after passing through the discharge path 12, or is transported to the sheet inverting section 40 depending on the selection of the changeover gate 11 provided in the transportation path 10. When the bookbinding designation has not been made in the operation section or the like of the image forming apparatus A, the sheet S1 is discharged to the sheet discharge tray 20.

When the sheet discharged from the image forming apparatus A is a cover sheet S2A, the cover sheet S2A is sent to the transportation path H1 due to the selection of the changeover gate G1. In addition, the cover sheet S2A passes through the cutter 81 to the cover sheet supporting section 90 through the changeover gate G2 that selects between it and the cover sheet S2B sent from the cover sheet storage section 80.

When the bookbinding designation has been made in the operation section or the like of the image forming apparatus A (this is called the bookbinding operation mode), the sheet S1 is conveyed to the sheet inverting section 40 via the transportation path 13, and after it is switched back in the sheet inverting section 40, it is transported to the collection section 50. In the collection section 50, the sheets S1 of the set number are accumulated, and once sheets of the set number have been accumulated in the collection section 50, they are gripped and rotated, and the resultant bundle of sheets Sa made of sheets S1 is held in the approximately vertical state.

An adhesive is coated by coating device 60 on the spine surface of the bundle of sheets Sa (the bottom end surface in FIG. 2) held in the approximately vertical state in the collection section 50. The cover sheet S2 comes into contact with and gets adhered to the bundle of sheets Sa on which the adhesive has been coated thereby preparing the book S3 to be discharged to the book discharging section 100.

Detailed explanation is given about the respective sections of the bookbinding apparatus in the following.

The sheet S1 conveyed through the transportation path 13 is discharged by the sheet discharging rollers 14 and transported by the swinging press contact rollers 401. After the sheet S1 rising on the inclined inverting tray 402, the swinging press contact rollers 401 rotate in the opposite direction conveying the sheet S1 in the downward direction. The sheet S1 conveyed in the downward direction falls into and gets collected in the collection section 50.

The sheet S1 that has been conveyed in the downward direction in the sheet inverting section 40 is supported in the inclined state in the collection section 50 by the sheet supporting unit including a supporting plate 502 and a receiving plate 506.

The sheets S1 discharged successively from the image forming apparatus are collected in the collection section 50, thereby forming a bundle of sheets Sa. The number of sheets S1 constituting the sheet bundle Sa is recognized not only from the number of document sheets counted using the automatic document feeder A2 mounted on the image forming apparatus or from the number of document sheets obtained from the original document image information transmitted via a personal computer or the like, but also from the number of document sheets inputted beforehand by the operator or the like.

The part designated by the number 504 is a member for suppressing the rising-up of the accumulated sheet S1, and gets separated and again comes into contact every time a sheet S1 is fed to the collection section 50 thereby pressing the sheet S1. The part designated by the number 505 is an alignment plate that aligns the side edges of the sheets.

As soon as sheets S1 of the set number is collected in the collection section 50, a holding plate 503 is actuated thereby gripping and holding the sheet bundle Sa.

With the sheet bundle Sa in the gripped and held state, the collection section 50 rotates with the shaft 501 as the axis, and the sheet bundle Sa is changed from the inclined state to the vertical state.

<Adhesive Coating Process>

Figure 3:
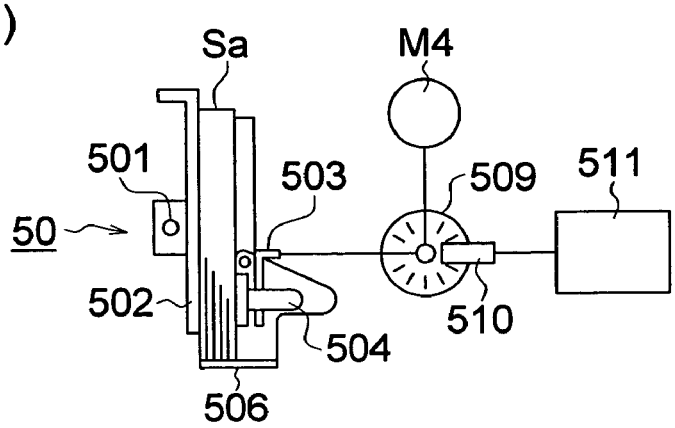
FIG. 3 shows the process of coating an adhesive while holding a bundle of sheets Sa in the vertical position in the collection section.
Figure 3:
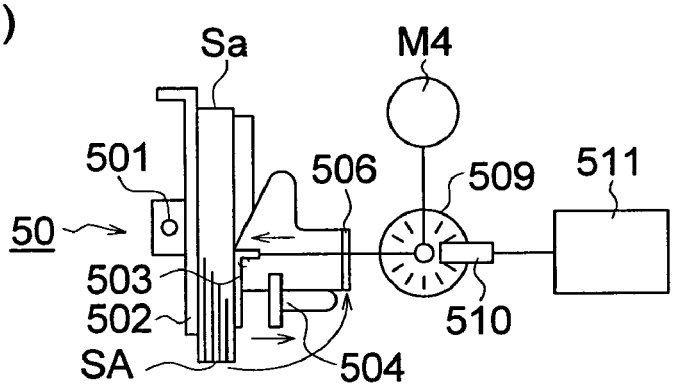
Figure 3:
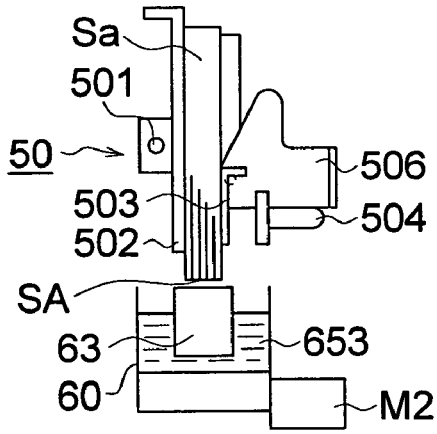
Figure 3:
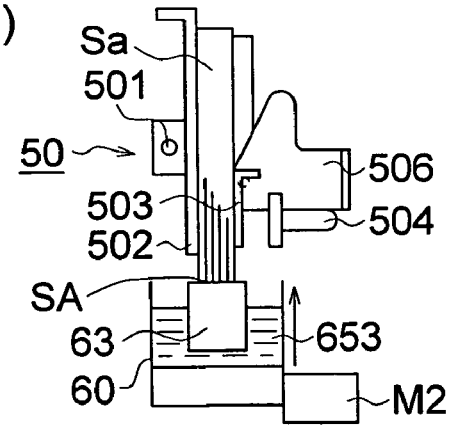

FIG. 3 shows the adhesive coating process while retaining the sheet bundle Sa in the collection section 50 in the vertical state.

Before describing the coating process, the supporting of the sheets by the holding plate 503 in FIG. 3(*a*) is described below.

Before rotating the collection section 50 to the vertical state, the holding plate 503 moves due to the drive of the motor M4, and presses the sheet bundle Sa. By stopping after detecting that the driving torque for pressing has reached a prescribed value, the sheet bundle Sa is retained strongly by the supporting plate 502 and the holding plate 503. The stopping position of the holding plate 503 is detected by the sensor 510 and the encoder 509, and is stored in the storage device of the position detection device 511. Because of this, it is possible to grasp the thickness of the sheet bundle Sa accumulated in the collection section 50 by actual measurement. The collection section 50 is rotated until it goes into the vertical state while strongly retaining the sheet bundle Sa by the supporting plate 502 and the holding plate 503 with the shaft 501 as the axis.

With the sheet bundle Sa in the retained state, the receiving plate 506 is rotated by 90 degrees thereby making it recede as shown in FIG. 3(*b*).

In the state of FIG. 3(*c*), the bottom surface SA of the sheet bundle Sa is separated from the coating roller 63.

As is shown in FIG. 3(*d*), the coating device 60 in which a hot melt adhesive material 653 is stored rises up due to the drive of a motor M2, and the coating roller 63 touches the bottom surface SA of the sheet bundle Sa in the figure. The coating roller 63, while being driven in a rotating manner by a motor M1 via a chain 64 shown in FIG. 2, moves in a direction at right angles to the surface of the paper on which FIG. 3 is illustrated, thereby coating the bottom surface of the sheet bundle Sa with the adhesive material 653.

The coating process is described next referring to FIG. 4.

Figure 4:
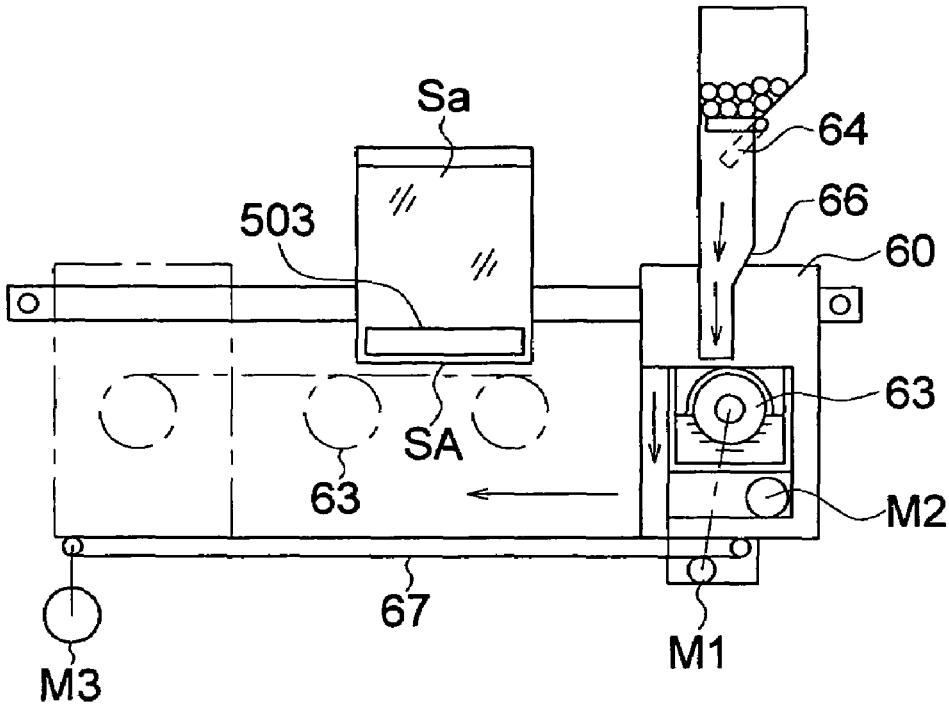
FIG. 4 shows the adhesive coating process.
Figure 4:
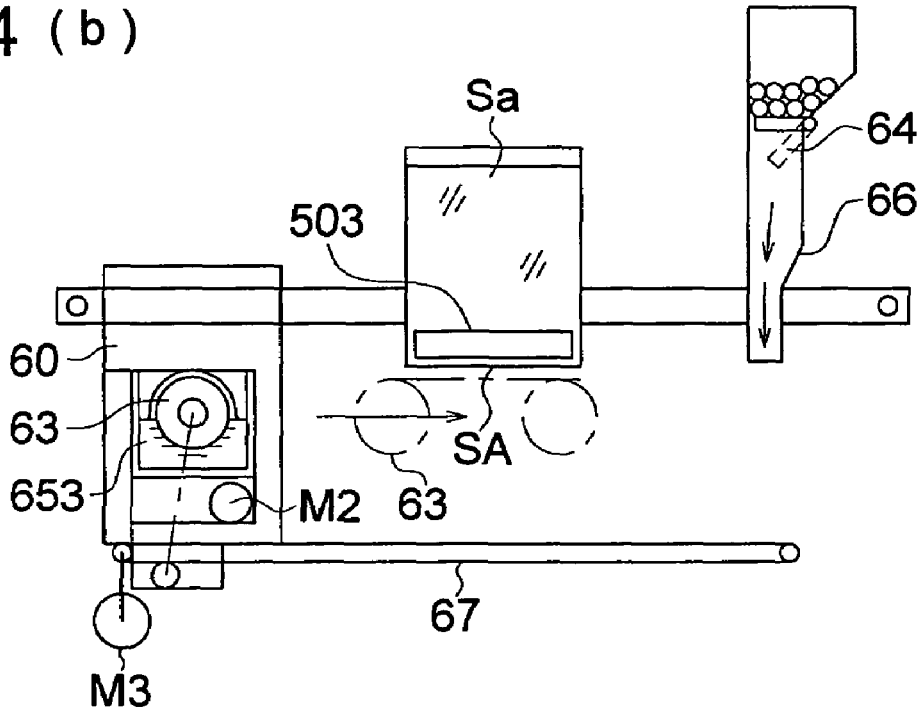

At the stage of starting the bookbinding in FIG. 4(*a*), the coating device 60 is at the right end position (the first position) which is its home position. This position is located at the deep end when viewed from the front of the bookbinding apparatus B shown in FIG. 2. In this right end position, solid adhesive material is replenished to the adhesive container via the replenishment path 66 because the door 64 becomes open. At the beginning of the bookbinding process, the coating device 60 moves from the home position towards the left in FIG. 4(*a*), the movement from this home position to the left end position (the second position) is carried out by the drive of a belt 67 (the second moving device) which is driven by a motor M3. The starting of the motor M3 is conducted based on the signal of the detection of the passing of the leading edge of the last of the sheets S1 constituting the sheet bundle Sa collected in the collection section 50, transmitted from the sheet sensor SE which is provided immediately below and on the downstream side of the inverting tray 402 (see FIG. 2). While the coating device 60 is moving to the left end position, the coating roller 63 is separated from the bottom surface SA of the sheet bundle Sa.

Further in the stage of FIG. 4(*b*) in which the coating device 60 moves from the left end position towards the right end position, the coating roller 63 rises due to the drive of the motor M2 and comes into contact with the bottom surface SA of the sheet bundle Sa thereby applying the adhesive material 653. The timing of starting the coating process of FIG. 4(*a*) is controlled so that, when the sheet bundle Sa has been put in the vertical state in which it can be coated, the coating is started after waiting for the transportation of the cover sheet to stop after trimming by the cutter 81.

Because of such timing control, the operations of respective parts are performed continuously and the bookbinding operation is conducted with a high efficiency. After the coating device 60 moves to the home position, the cover sheet S2 is joined to the sheet bundle Sa.

<Joining Process>

Figure 5:
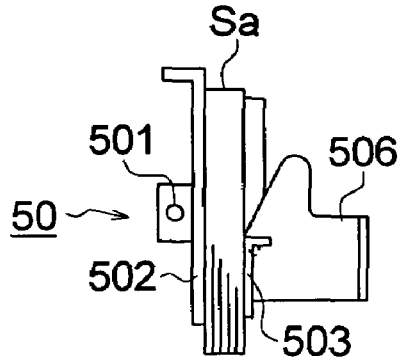
FIG. 5 is an outline cross-sectional view diagram related to the cover sheet supporting section that supports the cover sheet.
Figure 5:
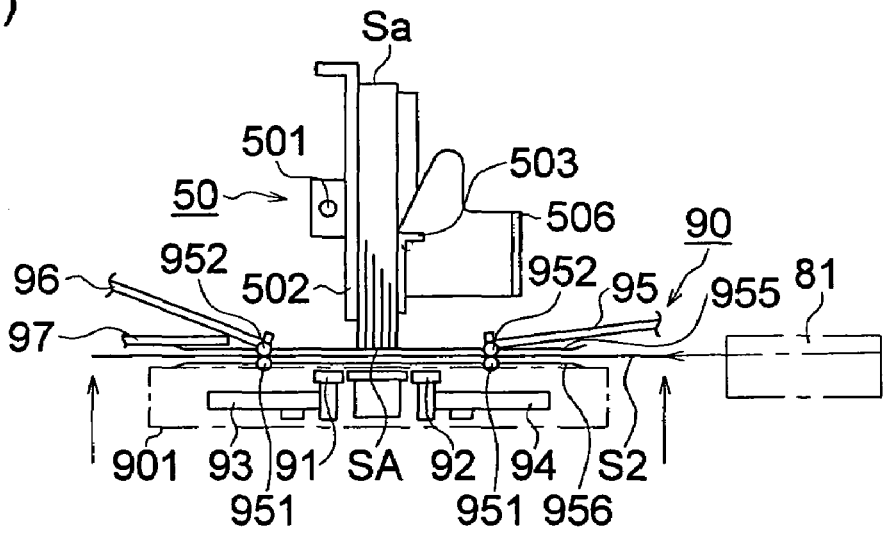
Figure 5:
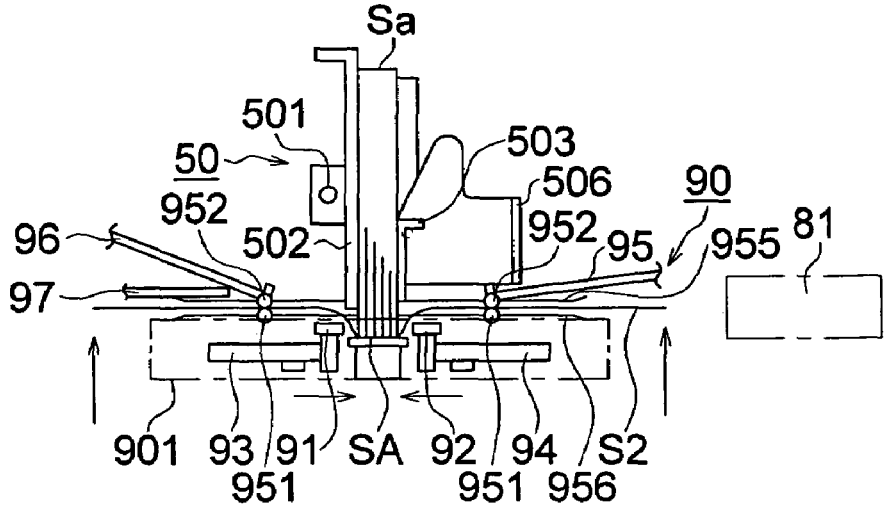

Next, the process of joining the sheet bundle Sa and the cover sheet S2 is explained below referring to FIG. 5 to FIG. 8. FIG. 5 is an outline cross-sectional view diagram related to the cover sheet supporting section 90 that supports the cover sheet.

The cover sheet S2 can be either the cover sheet S2A that is discharged from the image forming apparatus A and stored in the cover sheet supporting section 90 due to the selection of the transportation path changeover gate G1, or is the cover sheet S2B stored in the sheet feeding tray 801 of the cover sheet storage section 80 provided at the bottom part of the bookbinding apparatus as shown in FIG. 2.

The cover sheet S2B is used when an already printed cover sheet is to be used or when it is necessary to use a cover sheet on which it is not necessary to print. Further, when the bookbinding apparatus B is provided with a second image recording section as is described later, this is also used when printing is done directly on the cover sheet S2B using the second image recording section. In addition, by using the cover sheet S2B, since image recording on sheets S1 can be started without having to wait for the cover sheet S2A to be discharged from the image forming apparatus, there is the advantage compared to using the cover sheet S2A discharged by the image forming apparatus that the time taken for completion of bookbinding can be shortened and the productivity can be increased.

When the bookbinding apparatus B is provided with a second image recording unit 85 that records images on the cover sheets S2B, as is shown in FIG. 2, the second image recording unit 85 is placed in a transportation path from the cover sheet storage section 80 to the cover sheet supporting section 90. The second image recording unit 85 has a recording section using an ink jet method of the line head shape, or a thermal recording device having a thermal head and ink ribbons or the like, and can print directly on the cover sheet S2B.

The cover sheet S2A or S2B, after being aligned and switched back in the cover sheet supporting section 90, is cut to a length corresponding to the bundle of sheets S1 by the cutter 81 as a cutting device, conveyed by the transporting rollers, and is placed in the horizontal condition on the cover sheet supporting unit 901 indicated by a single-dot and dash line. The cover sheet supporting unit 901 is constituted using a plurality of members such as the pressing members 91 and 92, the cams 93 and 94 that drive the pressing members 91 and 92.

Further, the cutter 81 cuts the edge part of the cover sheet S2 to a length based on the information of the size of the cover sheet S2, the information of the size of sheets S1, and the information of the thickness of the sheet bundle Sa that is stored in the position detection device 511. However, regarding the information of the thickness of the sheet bundle Sa, apart from using the information obtained by actual measurement, it is also possible to calculate by multiplying the number of sheets based on the count of the document sheets, or the number of sheets obtained from the image information received from an external equipment, or from the received image information that has been inputted in the operation section of the image forming apparatus, by the thickness per sheet of the sheets S1 on which recording is to be made. The cutting shreds of the cover sheet S2 after trimming are stored in the storage box 82.

The cover sheet S2 cut to a prescribed length is conveyed by transporting rollers and is inserted between a top guide plate 955 and a bottom guide plate 956 provided with a spacing of about 5 mm. The cover sheet S2 is transported by the cover sheet transporting rollers 951 and the follower rollers 952 provided at the tips of the cover sheet pressing members 95 and 96. The cover sheet S2 is controlled so that it stops when it arrives at a prescribed position based on the size information of the cover sheet S2, and the information of the thickness of the bundle of sheets S1.

Figure 6:
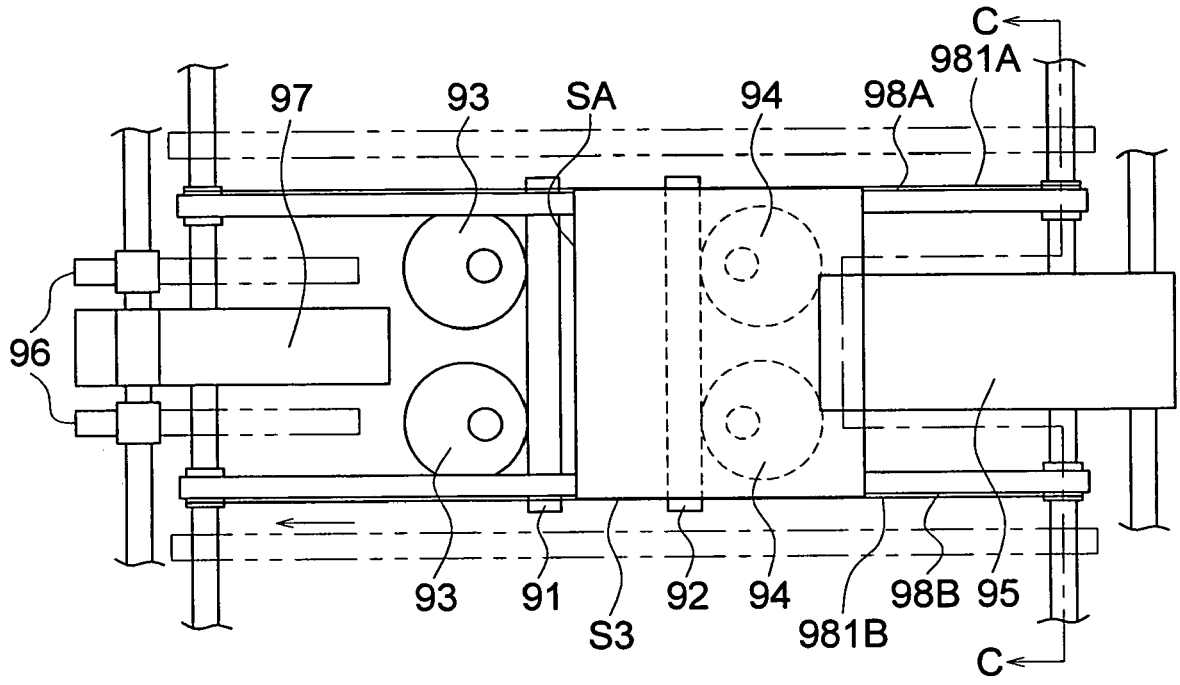
FIG. 6(*a*) is the top view diagram of the cover sheet supporting section, and FIG. 6(*b*) is the cross-sectional view diagram at the cross-section C-C in FIG. 6(*a*).
Figure 6:
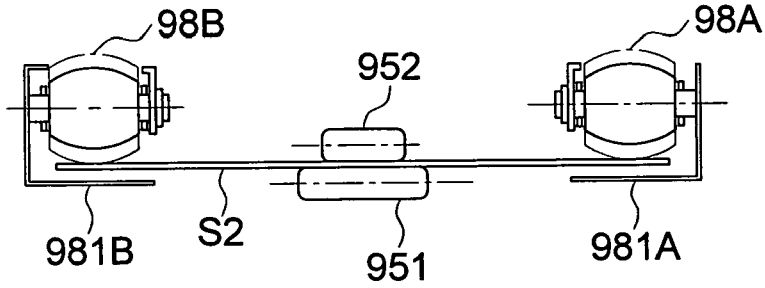

FIG. 6(*a*) is the top view diagram of the cover sheet supporting unit 901, and FIG. 6(*b*) is the cross-sectional view diagram at the cross-section C-C.

The belts 98A and 98B carry out a function of alignment operation of correcting the inclination of the cover sheet S2 that has been conveyed, and an operation of conveying the book S3 that has been bound, to the book discharging section 100.

As a device for the alignment of the cover sheet S2, the aligning members 981A and 981B are provided, that carry out alignment of both end surfaces of the cover sheet S2 in directions parallel to the direction of transportation, and drum-shaped rollers are provided on the aligning members 981A and 981B to extend the belts 98A and 98B. The aligning members 981A and 981B carry out the aligning operation every time a cover sheet S2 is supplied. In addition, when the cover sheet supporting unit 901 to be described later rises, the aligning members 981A and 981B and the belts 98A and 98B recede to the position shown by two-dots and one dash line in FIG. 6(*a*).

FIG. 5(*b*) is a diagram showing the cover sheet S2 pressed by pressing members 95 and 96, and being raised in that state along with the cover sheet supporting unit 901 due to the motor M that drives the belts 99A and 99B (see FIG. 2).

The cover sheet supporting unit 901 rises further by a few millimeters from the position shown in FIG. 5(*b*). This position after rising by a few millimeters is the position shown in FIG. 5(*c*). After rising, the pressing members 91 and 92 press the cover sheet S2 from left and right, make corners at the boundary between the front cover sheet and the spine cover of the book, and at the boundary between the spine cover and the back cover sheet, and the book S3 is formed by closely contacting the cover sheet S2 with the sheet bundle Sa. The duration for which the pressing members 91 and 92 are pressing is about 5 seconds, and the pressing force is about 200 Nf.

Further, the movement in the lateral direction of the pressing members 91 and 92 is obtained from the cams 93 and 94 (see FIG. 6) that are driven by motors (not shown in the figure). In addition, the device for the movement of the pressing members 91 and 92 can also have a configuration in which a rack is provided for, each member, so that the member can be moved by the rotation of a pinion that engages with the rack.

Figure 7:
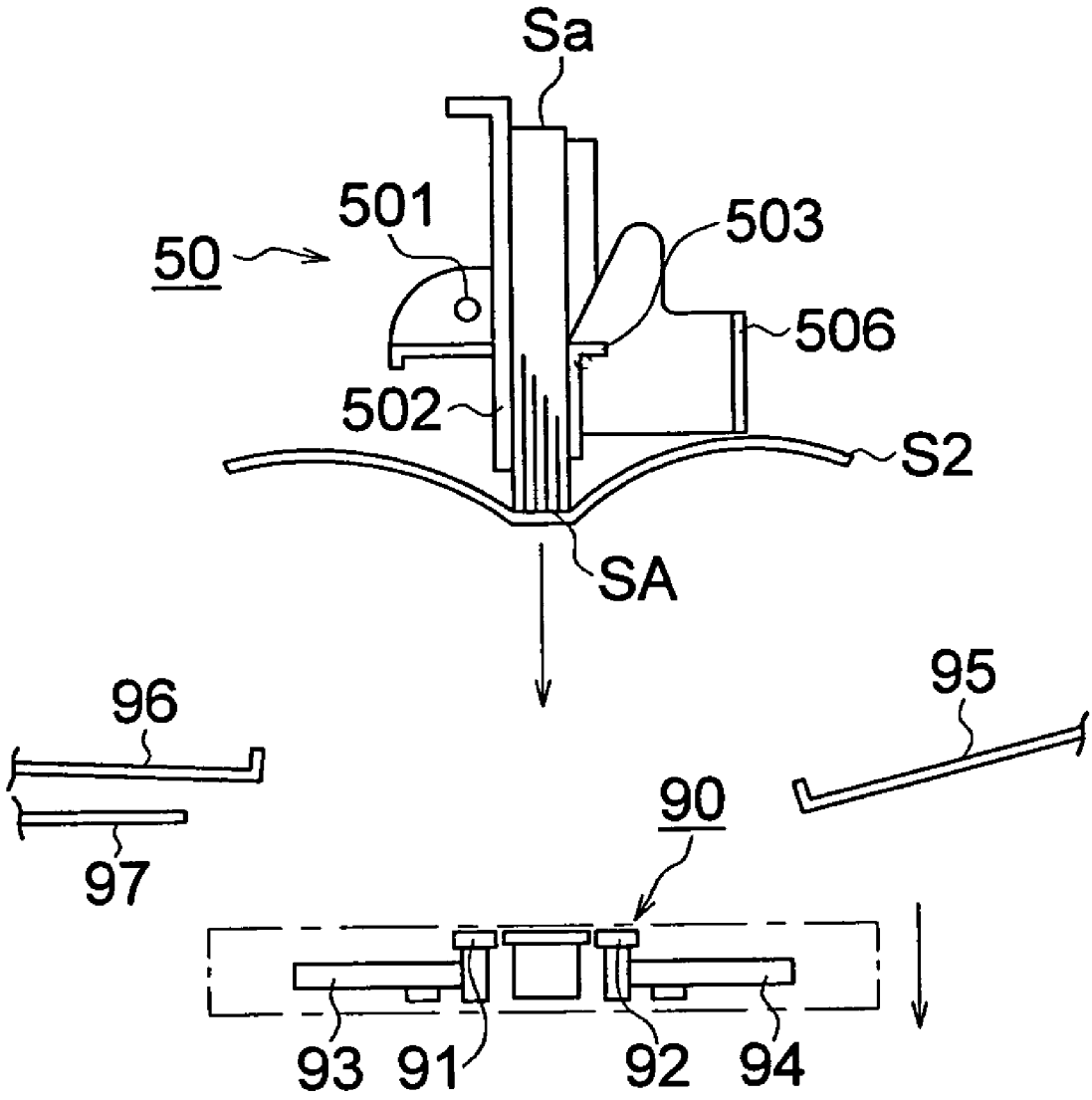
FIG. 7 is a diagram showing that the pressing on the cover sheet S2 by cover sheet pressing member is being released after the cover sheet S2 is joined.

The processing of the cover sheet S2 after it has been joined is explained below using FIG. 7.

When the cover sheet supporting unit 901 rises, the pressing members 95 and 96 are pressing the cover sheet S2 from above and maintain the cover sheet S2 in the flat state. A prescribed time period after the cover sheet S2 rises, the pressure of the pressing members 95, 96, and 97 is released due to the drive of a motor (not shown in the figure), and the state becomes that shown in FIG. 7. At this time, the cover sheet S2 goes into the state in which it is being lifted up by the cover sheet pressing member 97 that has been positioned below the cover sheet S2.

When the joining of the cover sheet S2 has been completed, the cover sheet supporting unit 901 that released the pressing members 91 and 92, lowers by about 100 mm due to the drive of the belts 99A and 99B (see FIG. 2) and returns to the home position.

At this time, in order to lift up the left and right sides of cover sheet S2 by about 50 mm, the cover sheet pressing members 95, 96, and 97 once go to the horizontal state from the vertical state, and then are again swung in the opposite direction.

Next, the belts 98A and 98B are moved so as to return to the position of narrower than the width of the cover sheet S2, and the cover sheet supporting unit 901 is raised by about 70 mm.

Figure 8:
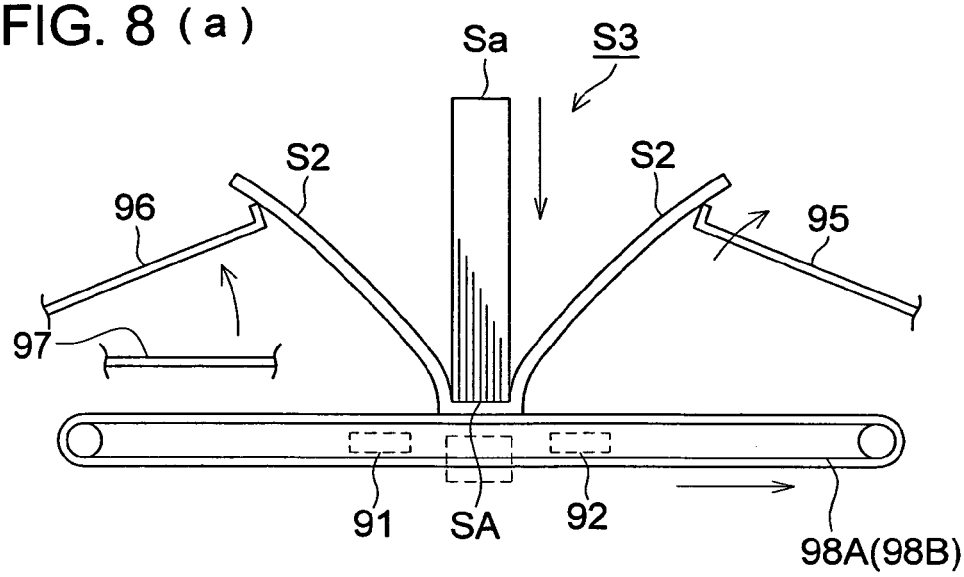
FIG. 8 shows the book S3 being dropped onto belt 98A and 98B and discharged.
Figure 8:
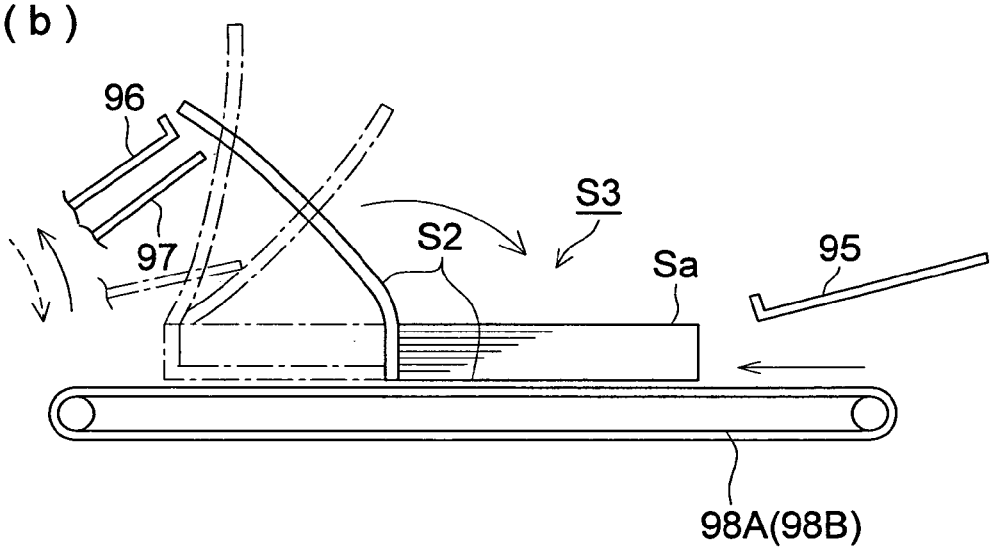
Figure 8:
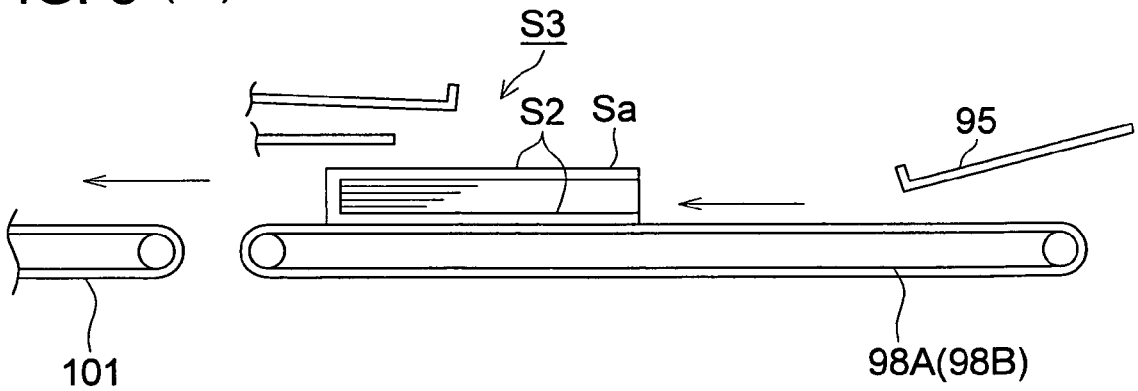

The holding plate 503 moves to the retracted position, so that the holding pressure is released. Because of this, the book S3 made up of the bundle of sheets S1 and the cover sheet S2 falls on the belts 98A and 98B (FIG. 8(*a*)). While lowering again the cover sheet supporting unit 901, the belts 98A and 98B are rotated, and the book S3 is conveyed toward the book discharging section 100 and is made to tumble there (see FIG. 8(*b* )). At this time, the cover sheet supporting members 96 and 97 are swung to a large extent toward the upward direction, and the left side cover sheet is lifted up. As is shown in FIG. 8(*c* ), the book S3 is conveyed up to the left end by the belts 98A and 98B and is discharged, as it is, to the book discharging section 100.

The book discharge table 101 is raised and lowered due to the drive of a belt, and the book discharge table 101 on which the book S3 is placed is lowered, the book S3 is transferred to the belt 102, and the book S3 is conveyed by the belt 102 and is discharged from the bookbinding apparatus.

<Flow chart>

Next the bookbinding system according to the present invention is described using the flow charts of FIG. 9 to FIG. 12. Further, in these flow charts, the parts during which the image forming apparatus carries out warming up from the start and until the initial checks of the respective sections have been completed are omitted for the sake of simplicity.

In the present system, the information of the images of the cover sheet and the image of the respective sheets can not only be received via a communication section A4 from a personal computer PC connected as an external equipment to the image forming apparatus A, but also can be obtained from the image reading section A3. In addition, when the image forming apparatus A itself can also have functions equivalent to that of a personal computer PC, and in the case of an apparatus in which images can be formed in the operation panel, the images formed on the operation panel can also be obtained as the image information.

Firstly, at the time of starting the preparation of the book S3, in Step 1, a judgment is made as to whether the image information of the cover sheet S2 has been received via the personal computer PC or has been received after the image information was prepared in the operation panel. The image information that is received can be only the image information of the front cover sheet, or else can also include other image information for the spine cover part or the image information of the back cover sheet. The operation jumps to Step 5 if the image information for the cover sheet S2 either has been received via a PC or has been received after being prepared in the operation panel. However, if the image information for the cover sheet S2 has not been received, the operation proceeds to Step 2, wherein the image being read out by the image reading section A3 of the image forming apparatus A is awaited. When the image for the cover sheet S2 is read out by the image reading section A3, the operation proceeds to Step 3, and a judgment is made as to whether the read out image is to be image-formed, as it is, in the cover sheet S2, or else, the image formation is to be done after changing the size of the read out image, or changing the recording position, or after carrying out some processing. (Step 4) When the judgment is made, the operation proceeds to Step 5.

In Step 5, a judgment is made as to whether or not the image information for each of the sheets S1 has already been received via the PC or the like. If the image information has already been received, the operation proceeds to the point indicated by A in FIG. 10 or to the point indicated by B in FIG. 11. If it is judged in Step 5 that the image information has not been received, the reading of the images of each of the sheets S1 by the image reading section A3 of the image forming apparatus A is awaited. When each of the images has been read out and the image information for each of the sheets S1 has been obtained, the operation proceeds to A in FIG. 10 or to B in FIG. 11.

Figure 10:
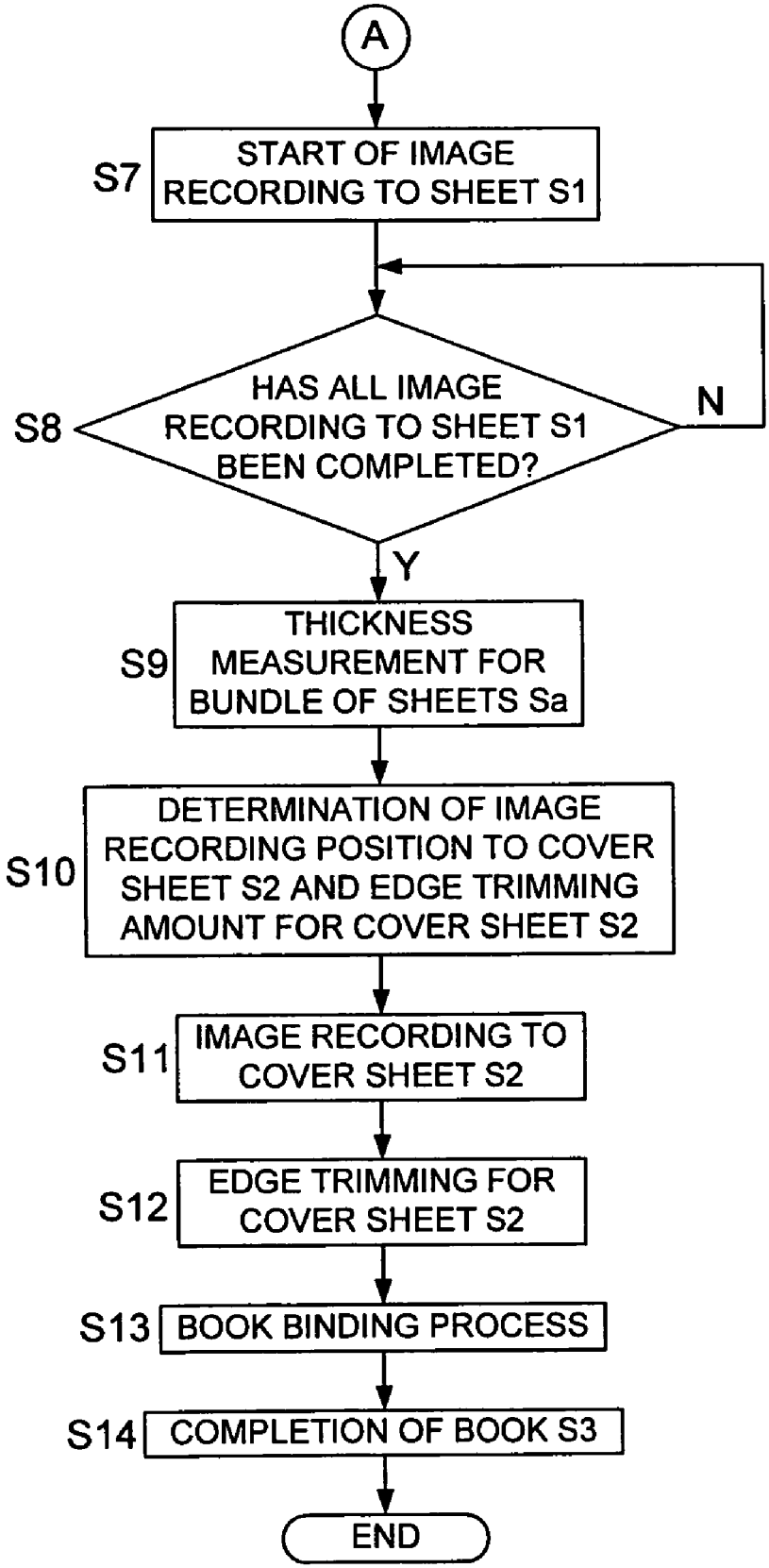
FIG. 10 is a flow chart of the bookbinding system according to the present invention.

Next, the operation proceeds to A in FIG. 10 if the thickness information of the sheet bundle Sa is to be obtained by actual measurement. On the other hand, the operation proceeds to B in FIG. 11 if the thickness information of the sheet bundle Sa is to be obtained by the multiplication of the number of sheets obtained from the image information for sheets S1 received via the personal computer PC or the like, by the thickness of the thickness information per each sheet of the sheets S1. In addition, the operation proceeds to B in FIG. 11 even when the thickness information of the sheet bundle Sa is to be obtained by the multiplication of the number of sheets obtained from the number of original document sheets counted by the document feeder A2 of the image forming apparatus A by the thickness of the thickness information per each sheet of the sheets S1.

In the following, in order to simplify the explanations, the descriptions are given for the case when only one of the book S3 is to be formed.

To begin with, description is given below for the case when the thickness information of the sheet bundle Sa is obtained by actual measurement.

Figure 9:
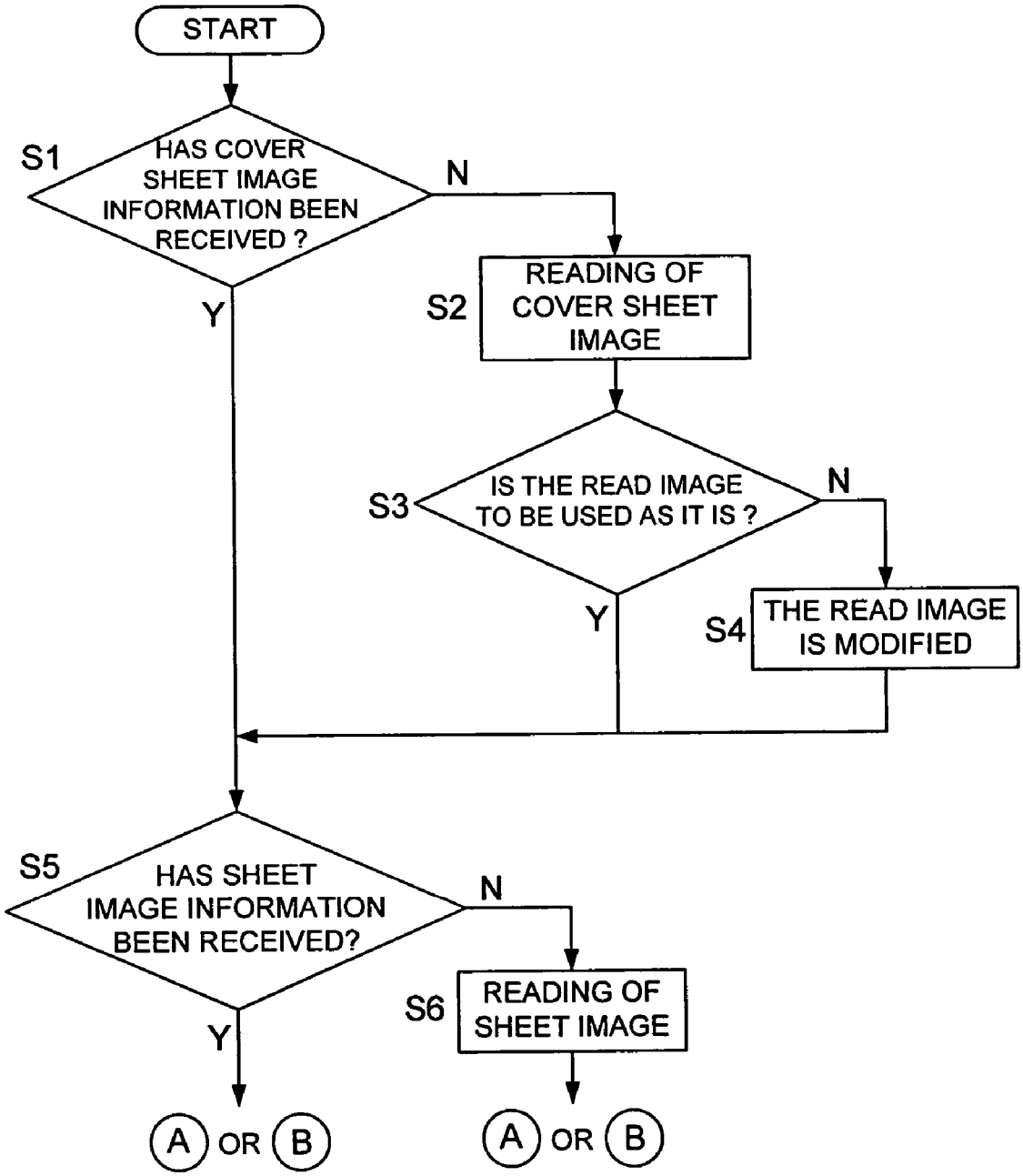
FIG. 9 is a flow chart of the bookbinding system according to the present invention.

After the Step 5 or the Step 6 of FIG. 9, the operation proceeds to Step 7 of FIG. 10, and the image formation for each of the sheets S1 constituting the sheet bundle Sa is started. The image formation is repeated until the image formation for all the sheets S1 has been completed (Step 8). When the image formation for all sheets S1 has been completed and the all the sheets S1 have been accumulated in the collection section 50 of the bookbinding apparatus B, the operation proceeds to Step 9 so that the motor M4 moves the holding plate 503, and the sheet bundle Sa is gripped by the supporting plate 502 and the holding plate 503 of the collection section 50. As has been described earlier, the stopping position of the holding plate 503 is detected by the encoder 509, and this information is stored in the storage device of the position detection device 511. From this stopping position, the information of the thickness of the sheet bundle Sa can be obtained.

Next, the operation proceeds to Step 10, the CPU of the image forming apparatus A, based on the stopping position stored in the storage device, computes the amount of trimming of the edge part of the cover sheet S2 and the position of recording the image of the cover sheet S2 after trimming it. At this time, in the case of an apparatus in which it is possible to select the size of the sheets S1 constituting the book S3 and the size of the cover sheet S2, the amount of trimming and the recording position are derived considering also the size information of the sheets S1 and the size information of the cover sheet S2.

On the other hand, in the case of a system in which the size of the sheets S1 that can be book-bound is limited to only one size and also cover sheet S2 of only one pre-determined size can be used, it is not necessary to consider the size information of the sheets S1 or the size information of the cover sheet S2 at the time of computing the amount of trimming and the recording position. Although the image recording on the cover sheet S2 is made before trimming its edge part, the recording positions of the images respectively on each of the areas of the front cover page, the spine cover part, and of the back cover page are shifted at the time of recording corresponding to the amount of trimming.

For example, in the case when equally spacing has been specified for the respective recording positions in each of the areas, at the time of recording the images, each image is recorded at a position that is shifted by an amount corresponding to the amount of trimming of the edge of the sheet from the position of the equally spacing of each area. In addition, for example, if in each area, the margin has been specified from the edge part of the area to the position of starting the image recording, the starting position of recording of each image will be the position shifted by a distance corresponding to the amount of trimming of the edge of the sheet from the margin part of that area. By shifting the recording position in this manner, the images can be recorded at the desired positions on the cover sheet S2 irrespective of the thickness of the sheet bundle Sa.

Figure 13:
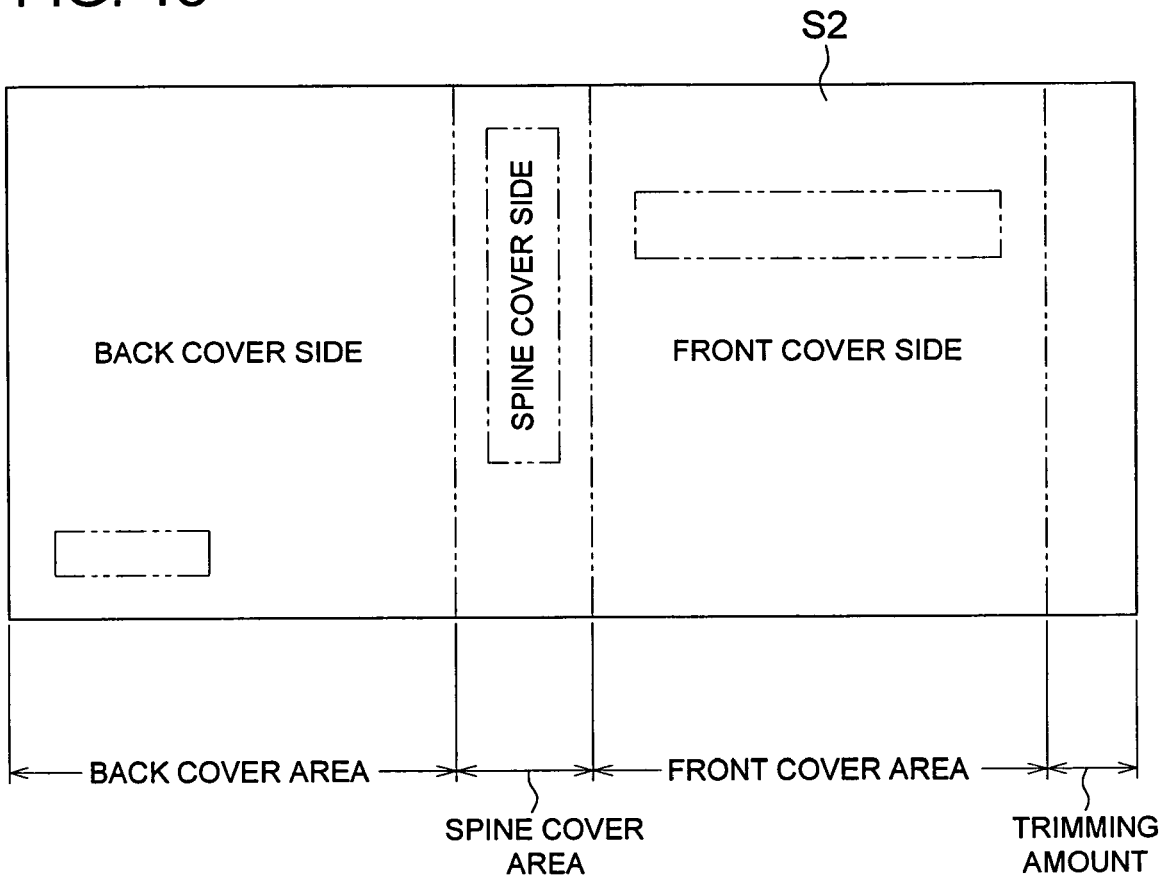
FIG. 13 is a diagram showing the cover sheet sizes and the ranges of the printing position.

When the positions of recording the images in the respective areas of the cover sheet S2 have been obtained, the operation proceeds to Step 11, and the images are recorded on the cover sheet S2 in the image forming section of the image forming apparatus A. FIG. 13 is a diagram showing, for the cover sheet S2, the printing positions of the images in the front cover sheet, the spine part of the cover sheet, and on the back cover sheet along with the trimming area of the edge part of the cover sheet S2 determined based on the thickness information of the sheet bundle Sa. FIG. 13 shows the cover sheet S2 in the state in which the front side and back side of the sheet have been reversed after the images have been recorded.

The cover sheet S2 after recording is sent to the cover sheet supporting section 90 of the bookbinding apparatus B, after its front and back sides have been reversed in the image forming apparatus A. After it is aligned in the cover sheet supporting section 90, the cover sheet S2 is transported to the trimming position of the cutter 81 by switching back by an amount corresponding to the amount of trimming of its edge part, and has its edge part trimmed (Step 12). Thereafter, the operation proceeds to Step 13, the cover sheet S2 with its edge part trimmed is joined with the bundle of sheets Sa, and the bookbinding operation is conducted by wrapping the cover sheet S2 around the sheet bundle Sa. The bound book S3 is discharged to the book discharging section 100 of the bookbinding apparatus B (Step 14), and the sequence of the operations of preparing the book S3 is completed.

Next, explanation is given below for the case when the thickness information of the sheet bundle Sa is obtained by the multiplication of the number of sheets obtained from the image information for sheets S1 received via the personal computer PC or the like, or the number of sheets obtained from number of original document sheets counted by the document feeder A2 of the image forming apparatus A, by the thickness of the thickness information per each sheet of the sheets S1.

Figure 11:
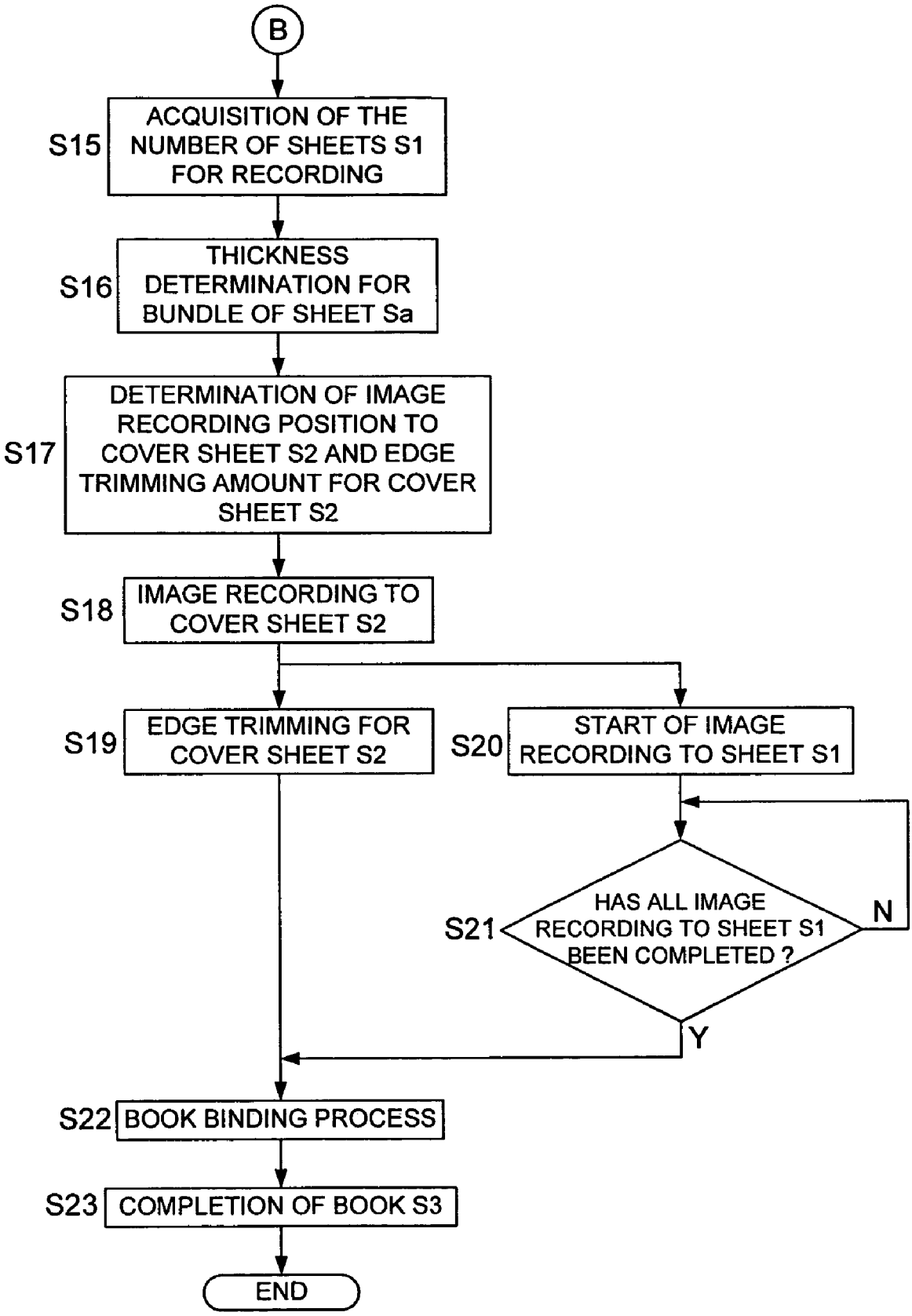
FIG. 11 is a flow chart of the bookbinding system according to the present invention.

After Step 5 or Step 6 of FIG. 9, the operation proceeds to Step 15 of FIG. 11. The number of sheets S1 required is grasped from the image information for sheets S1 received via the personal computer PC or the like, or from the information of the number of sheets inputted from the operation section of the image forming apparatus A, or from the number of sheets obtained from number of original document sheets counted by the document feeder A2 of the image forming apparatus A.

The operation then proceeds to Step 16, and the CPU of the image forming apparatus A computes the thickness of the sheet bundle Sa by multiplying the number of required sheets S1 by the value of the thickness of each sheet S1. The value of the thickness of each sheet S1 have been stored beforehand in the storage device ROM of the image forming apparatus A for each type of sheets such as thick sheet, ordinary sheet, thin sheet, or according to the basis weight of the paper. Thus, by specifying the type of sheet S1 used by the operator, the value of the thickness of the sheet S1 can be determined.

Next, in Step 17, according to the thickness of the sheet bundle Sa that has been obtained, the amount of trimming of the edge part of the cover sheet S2 is determined. Further, according to this amount of trimming, the recording positions of the images is determined in each of the areas of the front cover page, the back cover page, and the spine part of the cover sheet S2. At this time, similar to the explanation that was given for Step 10, in the case of an apparatus in which the size of the sheets S1 constituting the book S3 and the size of the cover sheet S2 can be selected, the amount of trimming and the recording positions are derived considering also the size information of the sheets S1 and the size information of the cover sheet S2. On the other hand, in the case of a system in which the size of the sheets S1 that can be book-bound is limited to only one size and also cover sheet S2 of only one pre-determined size can be used, it is not necessary to consider the size information of the sheets S1 or the size information of the cover sheet S2 at the time of computing the amount of trimming and the recording position. The same is true even regarding shifting the position of recording images according to the amount of trimming.

Next, the operation proceeds to Step 18, and the respective images are recorded by the image forming section of the image forming apparatus A at the image recording positions in each of the area of the cover sheet S2 as determined earlier. Here, by carrying out image forming on the cover sheet S2 before carrying out image forming on each of the sheets S1, the operations of the succeeding Step 19 and Step 20 can be carried out in parallel, and hence the productivity of producing the book S3 can be enhanced.

The cover sheet S2 on which images have been formed is sent to the bookbinding apparatus B after its front and back sides are inverted in the image forming apparatus A, and in Step 19, the edge part of the cover sheet S2 is trimmed by the cutter 81 of the bookbinding apparatus B based on the amount of trimming determined in Step 17. After the cover sheet S2 with images formed on it is sent to the cover sheet supporting section 90 of the bookbinding apparatus B and has been aligned there, it is switch-back transported by a distance based on the amount of trimming of its edge part and sent to the cutting position, whereupon it is trimmed by the cutter 81. After trimming the edge part of the cover sheet S2, the operation proceeds to Step 22.

On the other hand, simultaneously with Step 19, in the image forming apparatus A, the image forming is carried out of each of the sheets S1 (Step 20). When the image forming of all the necessary sheets S1 has been completed (Step 21), the operation proceeds to Step 22. In Step 22, the cover sheet S2 whose edge part has been trimmed is joined with the sheet bundle Sa and the processing of bookbinding by wrapping the cover sheet S2 around the sheet bundle Sa is carried out. The bound book S3 is discharged to the book discharging section 100 of the bookbinding apparatus B (Step 23), and the sequence of operations for preparing book S3 ends.

Figure 12:
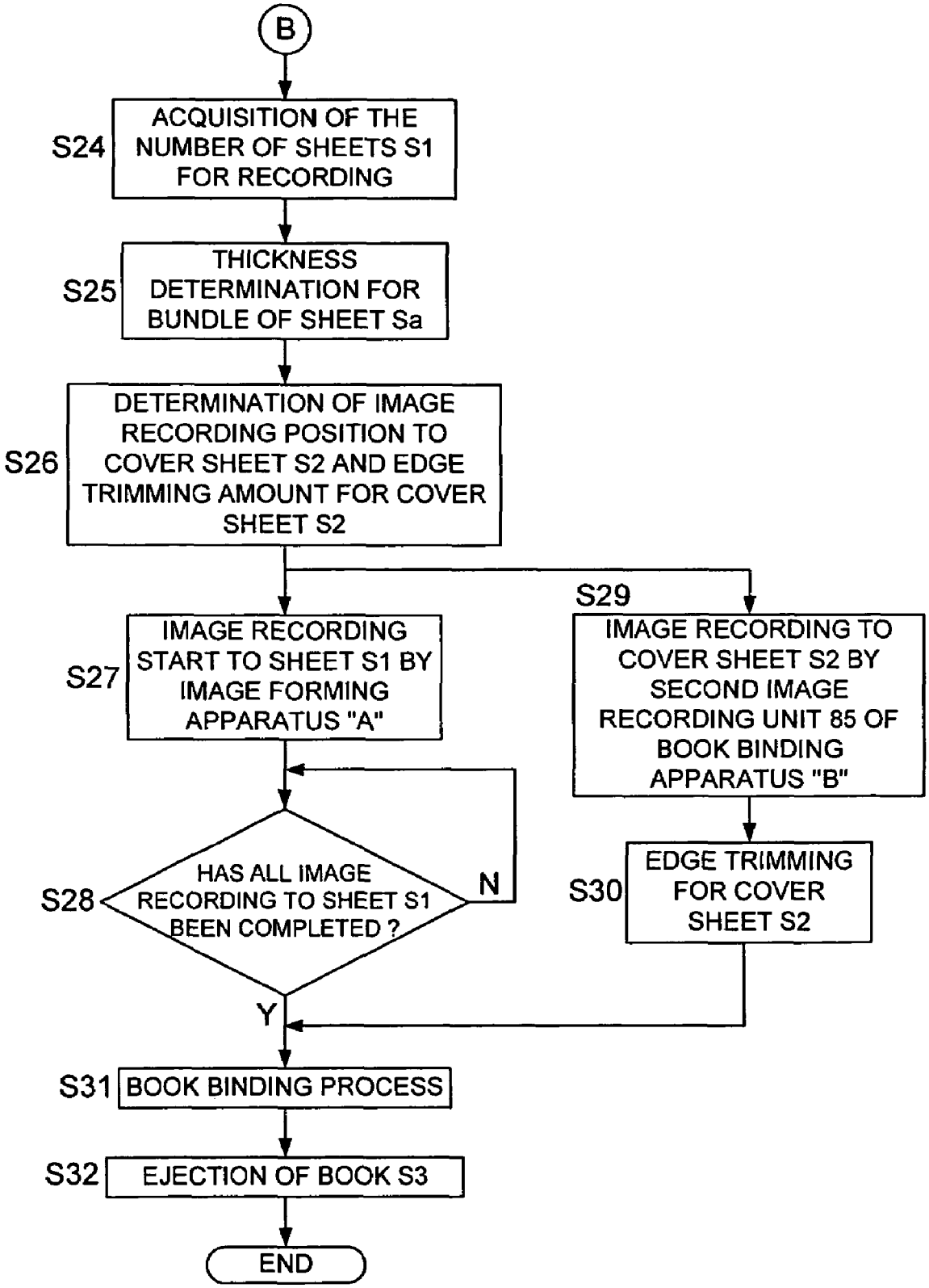
FIG. 12 is a flow chart of the bookbinding system according to the present invention.

The above explanations of the flow charts are for the case in which the image recording on the cover sheet S2 and the image recording on the sheets S1 are both carried out in the image forming apparatus A. However, in a system in which the bookbinding apparatus B is provided with a second image recording unit 85 and a second cover sheet storage section 80, while the cover sheet S2 is sent from the second cover sheet storage section 80 and images are recorded on the cover sheet S2 in the second image forming unit 85, image recording on the sheets S1 can be carried out in the image forming section of the image forming apparatus A. Because of this type of control, since it is possible to carry out separately the image recording on the cover sheet S2 and the image recording on the sheets S1, the productivity of preparing the book S3 can be enhanced. The flow chart shown in FIG. 12 is a flow chart related to such a type of control.

The operations proceed to Step 24 after Step 5 or Step 6 in FIG. 9. The number of sheets S1 required is grasped from the image information for sheets S1 received via the personal computer PC or the like, or from the information of the number of sheets inputted from the operation section of the image forming apparatus A, or from the number of sheets obtained from number of original document sheets counted by the document feeder A2 of the image forming apparatus A.

The operations moves on to Step 25, and the CPU of the image forming apparatus A computes the thickness of the sheet bundle Sa by multiplying the number of required sheets S1 by the value of the thickness of each sheet S1. However, the value of the thickness of each sheet S1, similar to the case that has already been described above, have been stored beforehand in the storage device ROM of the image forming apparatus A for each type of sheets such as thick sheet, ordinary sheet, thin sheet, or according to the basis weight of the paper. Thus, by specifying the type of sheet S1 used by the operator, the value of the thickness of the sheet S1 can be determined.

Subsequently, the operation proceeds to Step 26, and the amount of trimming of the edge part of the cover sheet S2 is determined according to the obtained thickness of the sheet bundle Sa. Further, in accordance with that trimming amount, the positions of recording images are determined for each of the areas of the front cover page, the spine part of the cover, and for the back cover page. At this time, similar to the case that has been described above, in the case of an apparatus in which the size of the sheets S1 constituting the book S3 and the size of the cover sheet S2 can be selected, the amount of trimming and the recording positions are derived considering also the size information of the sheets S1 and the size information of the cover sheet S2. On the other hand, in the case of a system in which the size of the sheets S1 that can be book-bound is limited to only one size and also cover sheet S2 of only one predetermined size can be used, it is not necessary to consider the size information of the sheets S1 or the size information of the cover sheet S2 at the time of computing the amount of trimming and the recording position. The same is true even regarding shifting the position of recording images according to the amount of trimming.

Next, the operation moves on to Step 27, and the recording of images starts on sheets S1 in the image forming section of the image forming apparatus A. The image recording is continued in the image forming apparatus A until the recording is completed on all the sheets S1 constituting the book S3 (Step 28). In parallel with the image recording in the image forming apparatus A, in the bookbinding apparatus B, a cover sheet S2B is sent out from the second cover sheet storage section 80 of the bookbinding apparatus B, and image recording is conducted on the cover sheet S2B by the second image recording unit 85 (Step 29). At this time, recording of the respective images on the cover sheet S2B is made so that the image recording positions match with those in each of the areas of the front cover page, the spine cover part, and the back cover page of the cover sheet S2 determined in Step 26.

Subsequently, the operation moves on to Step 30, the cover sheet S2B with images formed in each of the areas of it is sent to the cover sheet supporting section 90, and after it has been aligned there, it is switch-back transported by a distance based on the amount of trimming of its edge part and is sent to the cutting position of the cutter 81. After that, the edge part of the cover sheet S2B is trimmed.

When all the image recording on the sheets S1 and the trimming of the edge part of the cover sheet S2B has been completed, the operation proceeds to Step 31, the cover sheet S2B is joined with the sheet bundle Sa and the processing of bookbinding by wrapping the cover sheet S2B around the sheet bundle Sa is carried out, and the bound book S3 is discharged to the book discharging section 100 of the bookbinding apparatus B (Step 32), and the sequence of operations of preparing the book S3 ends.

<Stapling-bookbinding Apparatus C>

Next, as the second preferred embodiment, a stapling-bookbinding apparatus C using staples as the device for bookbinding is described below.

Figure 14:
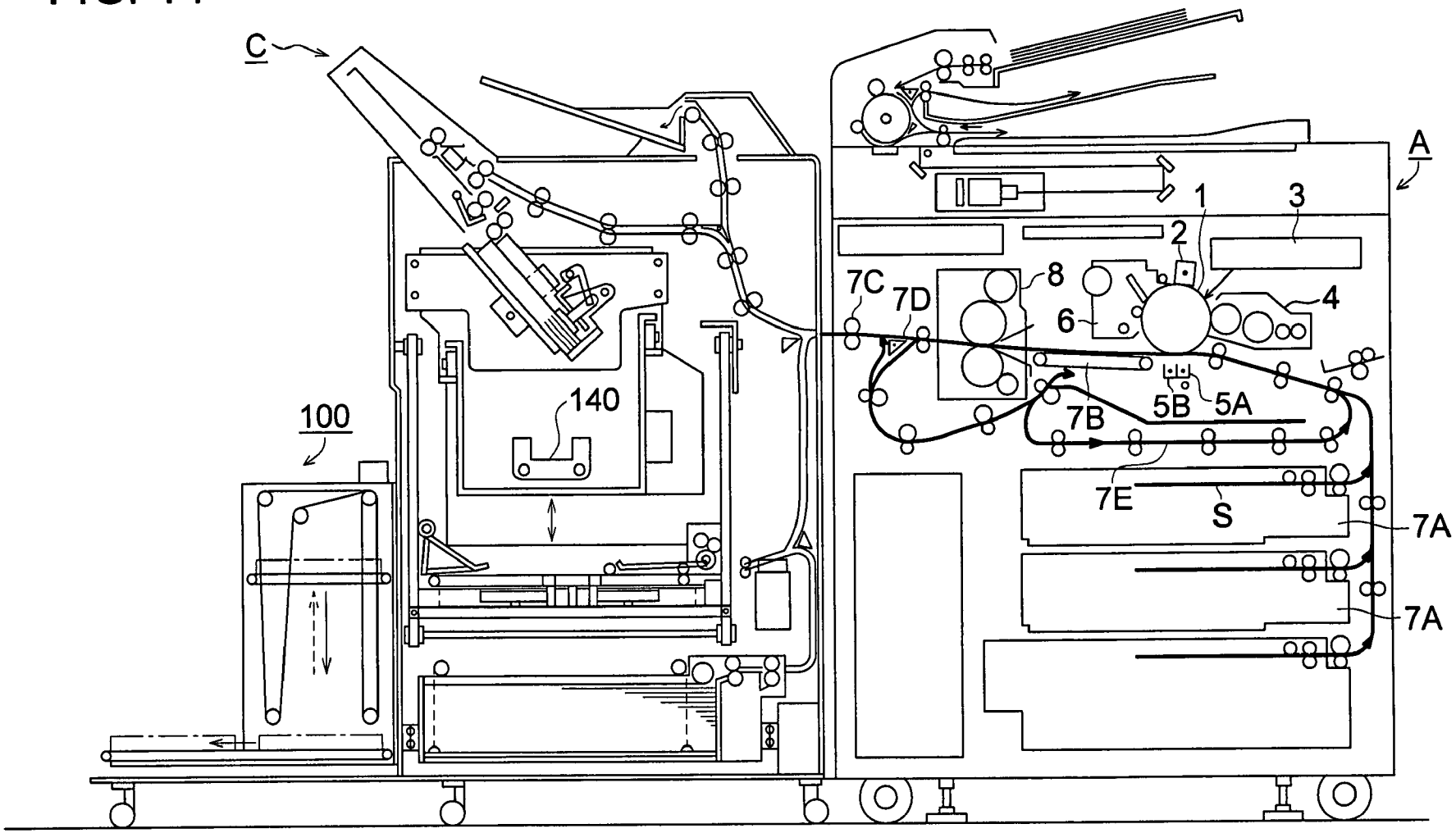
FIG. 14 is an outline cross-sectional view diagram of an image forming system provided with an image forming apparatus and a stapling-bookbinding apparatus.

FIG. 14 is an outline cross-sectional view diagram of a stapling-bookbinding apparatus. The parts with the same numbers as in FIG. 1 are abbreviated here. Also, further explanations are omitted because the operations are almost the same as in the case of the pasting and bookbinding operation excepting that stapling is used as the bookbinding method.

Figure 15:
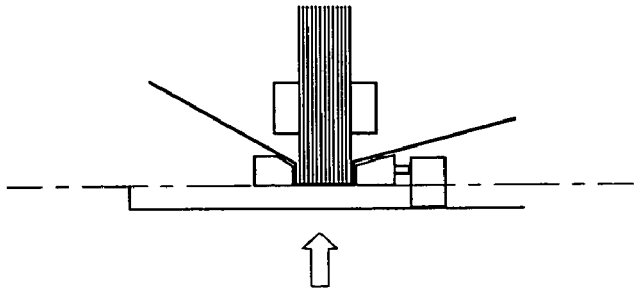
FIG. 15(*a*) is a diagram showing square spine formation and FIG. 15(*b*) is a perspective view diagram showing a booklet joined with a cover sheet, on which a square spine has been formed and which is being stapled using staples by the stapling device.
Figure 15:
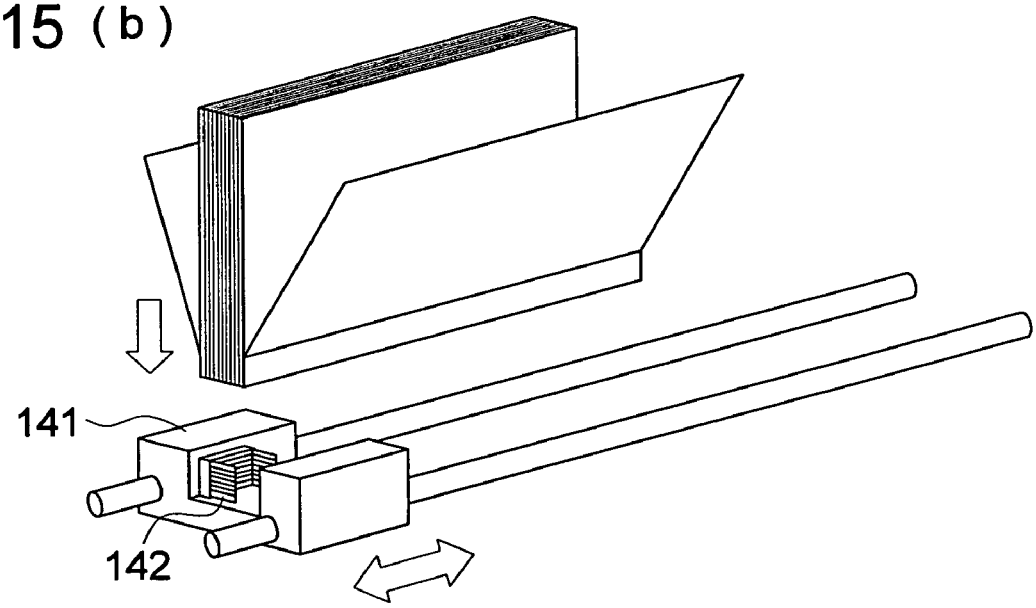

In FIG. 14, a stapling device 140 is used instead of the paste coating device 60, and FIG. 15(*a* ) is a diagram showing the process of square spine formation without coating paste on the bottom surface SA of the bundle of sheets Sa.

FIG. 15 (*b*) a perspective view diagram showing a booklet that has been joined with a cover sheet and has have a square spine formed being lowered to the position of the stapling section 141. After this, the stapling section 141 moves in the direction of the arrow, and the staples 142 are stapled at the prescribed positions. Although the staples are exposed in the case of the stapling-bookbinding method and the product quality get deteriorated compared to the pasting and bookbinding method, this type of bookbinding is used widely because the structure is simple.

What is claimed is:

1. A bookbinding system comprising:

an image forming apparatus having:

a first cover sheet storing section; and a first image recording device configured to record an image on a cover sheet supplied from the first cover sheet storing section;

a bookbinding apparatus having:

a second cover sheet storing section;

a second image recording device configured to record an image on a cover sheet supplied from the second cover sheet storing section;

a trimming device configured to trim an end of a cover sheet supplied from either of the first cover sheet storing section or the second cover sheet storing section; and a binding device configured to bind a trimmed cover sheet around a bundle of sheets; and a control device configured to control one or more of recording an image on a cover sheet, trimming an end of a cover sheet, and binding a cover sheet around a bundle of sheets, based on a determined thickness of the bundle of sheets;

wherein the bookbinding system is configured to supply a cover sheet from the second cover sheet storing section to the trimming device without passing the cover sheet through the first image recording device.

2. The bookbinding system of claim 1, wherein the control device is configured to determine a thickness of the bundle of sheets based on a number of sheets contained in the bundle of sheets and a known thickness of each of the sheets.

3. The bookbinding system of claim 1, wherein the control device is configured to determine a thickness of the bundle of sheets based on a measured distance traveled by a member holding the bundle of sheets.

4. The bookbinding system of claim 1, wherein the binding device comprises an adhesive coating device configured to coat an adhesive on an end surface of the bundle of sheets so as to adhesively bond a cover sheet to the end surface.

5. The bookbinding system of claim 1, wherein the binding device comprises a stitching device configured to stitch a cover sheet to the bundle of sheets using a stitching material.

6. The bookbinding system of claim 1, wherein the trimming device is configured to trim an end of a cover sheet based on a size of the cover sheet and a size of sheets contained in the bundle of sheets.

* * * * *